US005800320A

United States Patent [19]

Ray

[11] Patent Number: 5,800,320

[45] Date of Patent: Sep. 1, 1998

[54] QUICK CHANGE ADJUSTABLE HEIGHT SPEED BAG

[76] Inventor: Randy Ray, Route 2, Box 127, Noel, Mo. 64854

[21] Appl. No.: 759,118

[22] Filed: Dec. 2, 1996

[51] Int. Cl.[6] ..... A63B 69/00; A63B 69/24

[52] U.S. Cl. ..... 482/87; 482/83; 482/908

[58] Field of Search ..... 482/83, 84, 85, 482/86, 87, 88, 89

[56] References Cited

U.S. PATENT DOCUMENTS

| | | | |
|---|---|---|---|
| 992,868 | 5/1911 | Gorman | 482/87 |
| 1,708,638 | 4/1929 | Smith . | |
| 2,012,899 | 8/1935 | Thorson . | |
| 2,697,603 | 12/1954 | Haines | 482/54 X |
| 4,441,706 | 4/1984 | Korzaniewski . | |
| 4,491,316 | 1/1985 | Prince . | |
| 5,147,258 | 9/1992 | Donahue | 482/87 |
| 5,484,364 | 1/1996 | Boring | 482/87 |

FOREIGN PATENT DOCUMENTS

| | | | |
|---|---|---|---|
| 0461281 | 6/1928 | Germany | 482/86 |

*Primary Examiner*—Richard J. Apley
*Assistant Examiner*—William LaMarca
*Attorney, Agent, or Firm*—Jacobson, Price, Holman & Stern, PLLC

[57] ABSTRACT

An apparatus for practice and demonstrating defense arts, such as karate, includes a vertical wall-mounted main frame unit assembled of a pair of vertical, symmetrical, cylinder shaped tubes secured to three horizontally extending wall mounting brackets. The purpose of the invention is to support a height adjustable hanging target, such as a speed bag, which the artisan strikes with various human appendages, such as the hand or foot and other certain appropriate weapons. The hanging target is supported by a striking bag carriage assembly and a striking bag platform as it rides along the vertical tubing.

13 Claims, 8 Drawing Sheets

QUICK CHANGE ADJUSTABLE HEIGHT SPEED BAG

FIELD OF THE INVENTION

The present invention pertains to an apparatus which supports a target, such as a striking bag, for practicing and demonstrating defense arts, such as karate, by striking blows delivered by the hand or foot and other appropriate weapons. The quick adjustment of height facilitates effective practice or demonstration by the shortest to the tallest of artisans.

BACKGROUND OF THE INVENTION

There is a need for a striking apparatus which combines features of adequate safety, ease of adjustment of height, maximization of space utilization, ease of installation, cosmetic acceptability, reasonable design simplicity and quick and easy progress monitoring in the art of self defense where swift and effective blows are to be delivered accurately and blocked successfully.

SUMMARY OF THE INVENTION

The needed features have been incorporated into the present invention and facilitate excellent skill development for all ages and sizes of artisans.

Accordingly, an object of present invention is to provide an apparatus for practice toward development of excellent skills in the defensive arts such as karate.

An apparatus according to the present invention for practice and demonstrating defense arts, such as karate, includes a vertical wall-mounted main frame unit assembled of a pair of vertical, symmetrical, cylinder shaped tubes secured to three horizontally extending wall mounting brackets. The purpose of the invention is to support a height adjustable hanging target, such as a speed bag, which the artisan strikes with various human appendages, such as the hand or foot and other certain appropriate weapons. The hanging target is supported by a striking bag carriage assembly and a striking bag platform as it rides along the vertical tubing.

The three wall mounting brackets are constructed of rectangular steel tubing and facilitate versatile wall mounting at either sixteen or twenty-four inch stud center spacing. These brackets are firmly mounted to the wall with lag screws or other appropriate types of mounting fasteners.

The bottom of the frame sits at floor level and preferably extends to a height of eight feet and optionally to a height of ten feet. The wall bracket tubing is end capped with protective plastic inserts. The cylindrical tubing is capped off at floor level only with protective caps allowing a cable extending from the top of the cylindrical tubes to move restriction free in and out of the cylindrical tubes.

The striking bag carriage assembly and striking bag platform ride up and down along the cylindrical tubes on four free rolling nylon roller bearing assemblies and are counterbalanced with two weights. The weights are enclosed within the main frame cylindrical members and are supported by rollers and cables.

Attached to the carriage assembly are two friction locks, controlled by two hand operated knobs. The knobs serve as hand grips to raise and lower the carriage assembly to the desired elevation.

The striking target will normally be a vinyl strike bag with lacing, welted seams, a removable air bladder and a reinforced attachment loop. The striking bag platform has a chrome plated, target locking, ball-bearing swivel mounted at its center to which a striking target is attached. The perimeter of the striking bag platform is lined with soft, impact resistant, rubber edging for added striking safety. The upper and lower surfaces of the striking bag platform are faced with high impact resistant sheeting for wear resistance and cosmetic appearance.

Attached to one side of the vertical main frame unit is an inch/foot measuring scale for ready gauging of desired height of the striking bag platform assembly and for monitoring individual progress.

The present invention provides a support for a target, such as a striking bag, on which the blow is to be struck, which is adjustable through a wide range of vertical positions. This allows the artisan to practice striking and blocking skills over the entire range of normal points of aim and attack.

By the present invention, individuals of all heights and ages can practice numerous striking and blocking skills in the art of self defense on the same equipment and yet be equally challenged. As one continues to improve, they can monitor their individual progress with the scale attached to the vertical main frame unit.

In one aspect of the present invention, the artisan can improve their aim, force and technique in numerous hand strikes such as side-fist punches, ram's head and hammer head punches, and also various backhand strikes, palm heel hits, and finger strikes.

In another aspect of the present invention the artisan can improve their aim, force and technique in a number of different foot strikes and kicks, such as crescent kicks, rear kicks, chicken kicks, wheel kicks, and various spinning, jumping and flying kicks. This improves aim, strength, force and balance.

A third aspect of the present invention is the versatility the artisan has due to the wide range of height adjustment this apparatus affords. One can practice from below the knee kicks such as "shin kicks" to above the shoulder kicks. The artisan can also practice hand, wrist and elbow strikes at various levels of position.

A further aspect of this invention is that the artisan can use the striking target to practice striking from various positions with certain appropriate striking weapons such as a staff and a yawara stick.

The present invention also allows for one to practice upper body blocking skills from the returning blow of the target.

The present invention maximizes space utilization and provides ease of installation. It is wall mounted to increase stability and greatly reduces required space for utilization. Wall mounting holes are spaced to accommodate wall studs on sixteen or twenty-four inch centers. The mounting of an apparatus can also be adapted to other types of wall construction. The user of this invention will also appreciate the safety features incorporated into this apparatus.

The striking bag platform is readily and easily adjustable with two hand operated stabilizing locks. The entire striking bag carriage assembly is counterbalanced for ease and safety during elevation changes. The perimeter of the striking bag platform is protected by a soft rubber edging that in turn helps to protect the artisan from misplaced blows. The weighted counterbalances and cable pulleys are enclosed to protect the operator from possible injury.

In the event of a counterweight becoming detached from its cable and falling, the counterweight is entirely enclosed within a cylindrical tube to prevent bodily contact. Also, two balancing assemblies are utilized, reducing the probability of injury resulting from total machine failure.

The strike target is swivel mounted not only to provide for a free range of movements from various angles of position, but also to eliminate resistance to strike angles. A rebounding backboard allows the artisan to practice reaction time and training to successfully respond to returning blows of the target with strikes and/or blocks.

Accordingly, it is an object of the present invention to provide a quick change adjustable height speed bag which is movable by two counterweights enclosed within two vertically extending tubes.

It is another object of the present invention to provide an adjustable height speed bag by moving a striking bag carriage assembly to a predetermined position and fixing the location of the carriage assembly by two bearing and lock assemblies.

It is still another object of the present invention to provide an adjustable height speed bag having a striking bag platform assembly mounted on a striking bag carriage assembly with the carriage assembly being manually vertically movable against the force of two counterweights housed within two vertically extending tubes and with the position of the carriage assembly being fixable at a predetermined location.

These and other objects of the invention, as well as many of the intended advantages thereof, will become more readily apparent when reference is made to the following description taken in conjunction with the accompanying drawings.

DETAILED DESCRIPTION OF THE PREFERRED EMBODIMENTS

Figure 1:
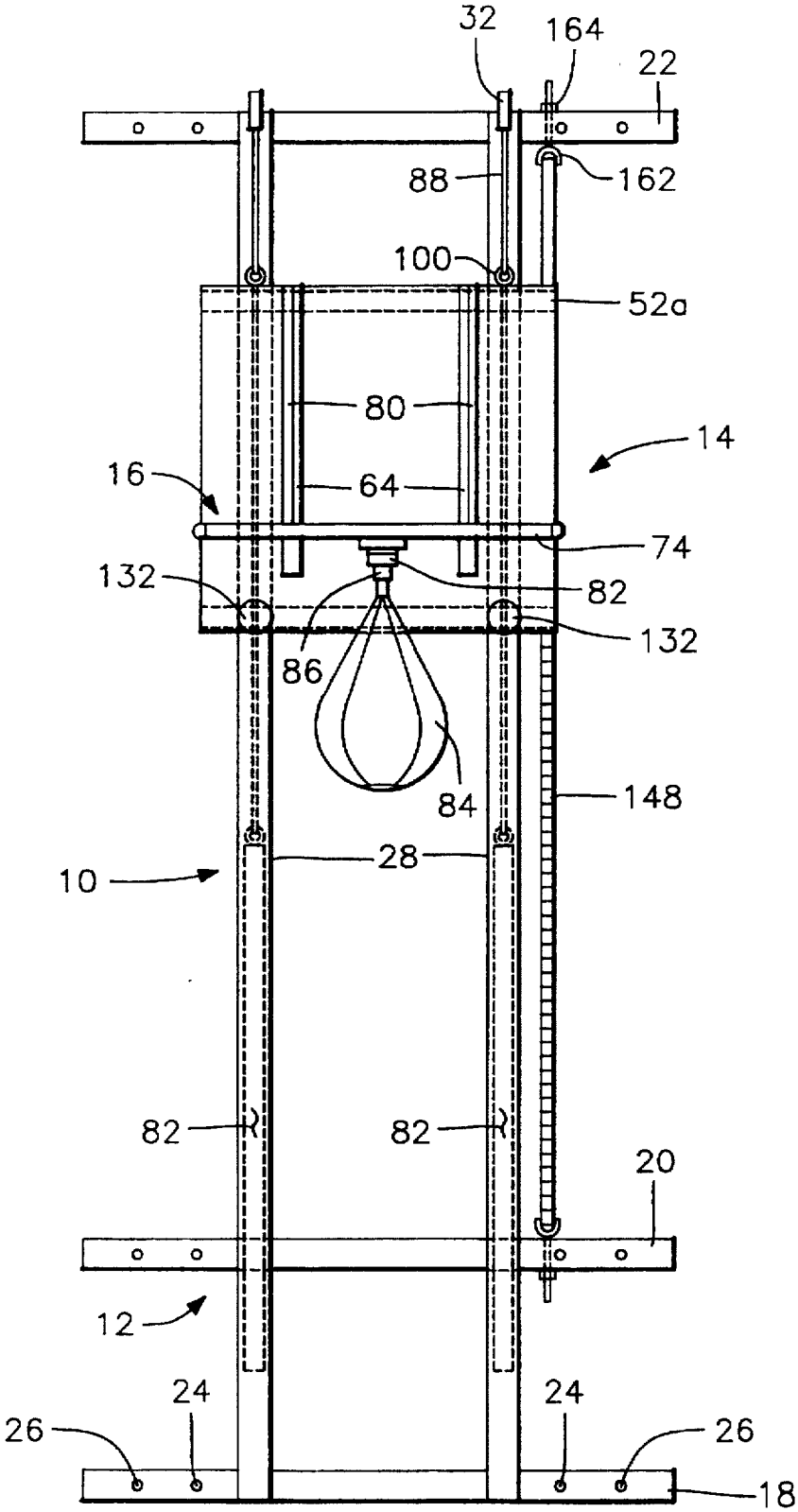
FIG. 1 is a front elevational view of an apparatus for practicing defense arts in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
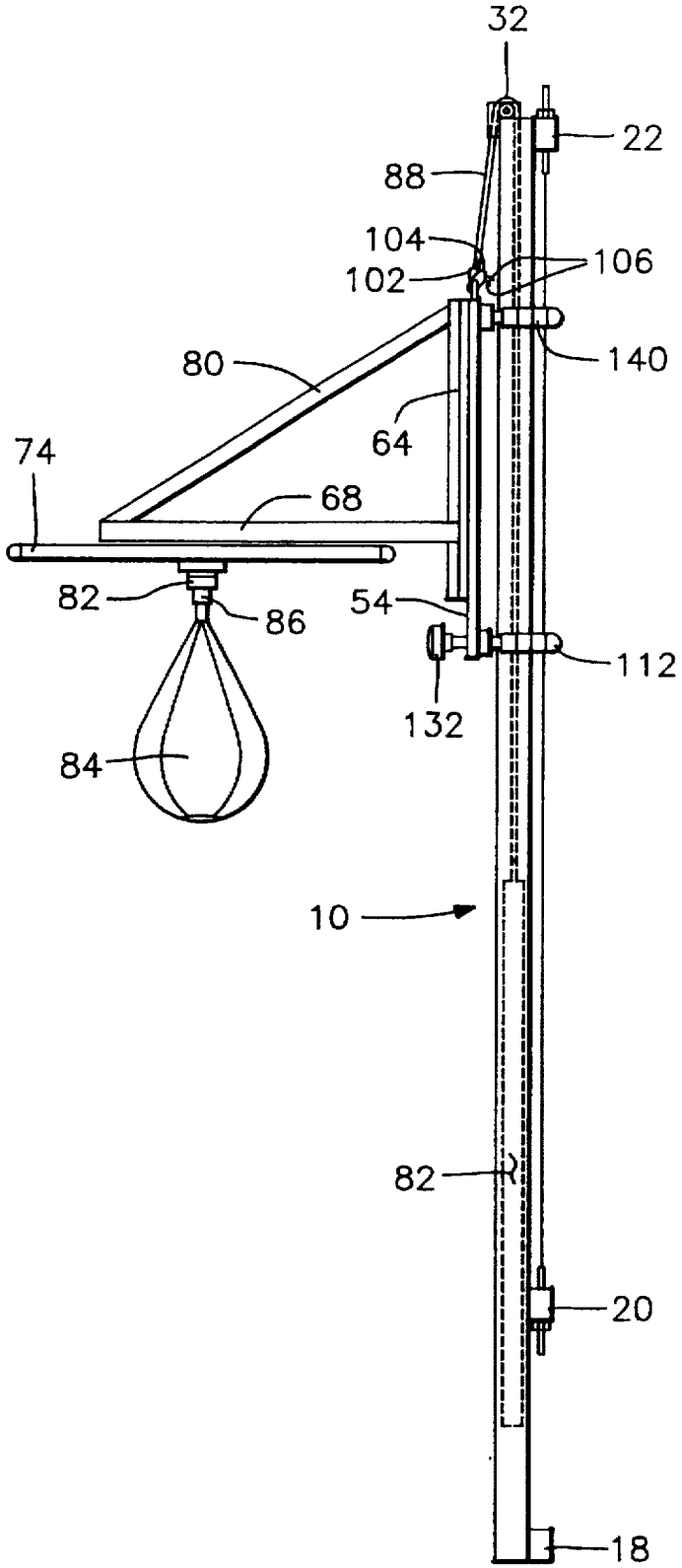
FIG. 2 is a side elevational side of the apparatus shown in FIG. 1.

With reference to the drawings, in general, and to FIGS. 1 and 2, in particular, a quick change adjustable speed bag embodying the teachings of the subject invention is generally designated as 10. With reference to its orientation in FIG. 1, the quick change adjustable speed bag 10 includes a vertical main frame unit 12, a striking bag carriage assembly 14 and a striking bag platform assembly 16.

The main frame unit 12 includes three horizontally oriented and vertically spaced brackets 18, 20 and 22 made of rectangular tubes. Bracket 18 is positioned at floor level. Each of the tubes includes holes 26 for securing the brackets to a vertical wall having studs located at sixteen inch centers. Holes 24 are for securing the brackets to studs spaced on twenty-Four Inch centers.

Included in the frame unit 12 are two vertically extending cylindrical tubes 28. The tubes 28 extend between and are secured to brackets 18, 20 and 22.

Figure 3:
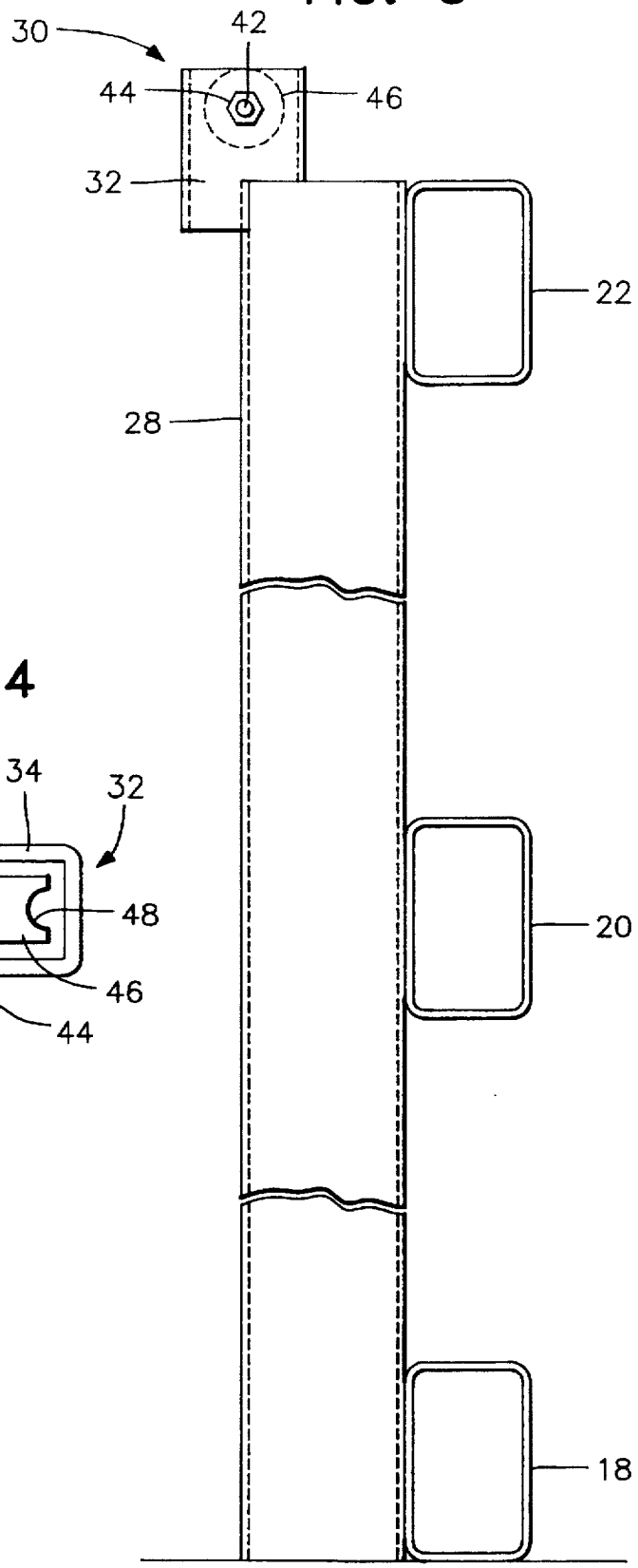
FIG. 3 is a detailed view of the vertical main frame which attaches to a vertical wall and on which the striking bag assembly is mounted.
Figure 4:
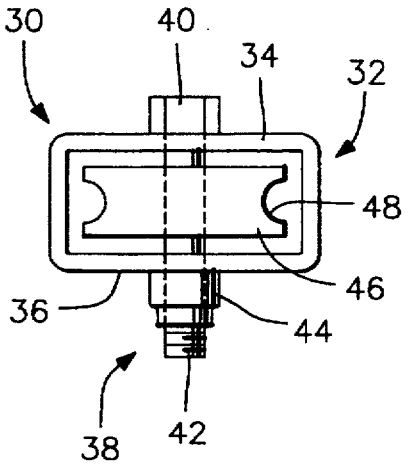
FIG. 4 is a further detailed view of the pulley assembly for the cable attached to the striking bag carriage assembly and the counter weight inside of the vertical main frame.

With reference to FIGS. 3 and 4, at the top of each of the tubes 28 is a pulley assembly 30. The pulley assembly includes a section of rectangular-shaped tubing 32 through which extends, through opposite side walls 34, 36, a bolt 38 having head 40 and threaded end 42 onto which is secured a nut 44. Located within the interior of the tube section 32 is a pulley 46 rotatably mounted on the shaft of the bolt 38. The pulley includes an arcuate groove 48 for receipt of a steel cable.

Figure 5:
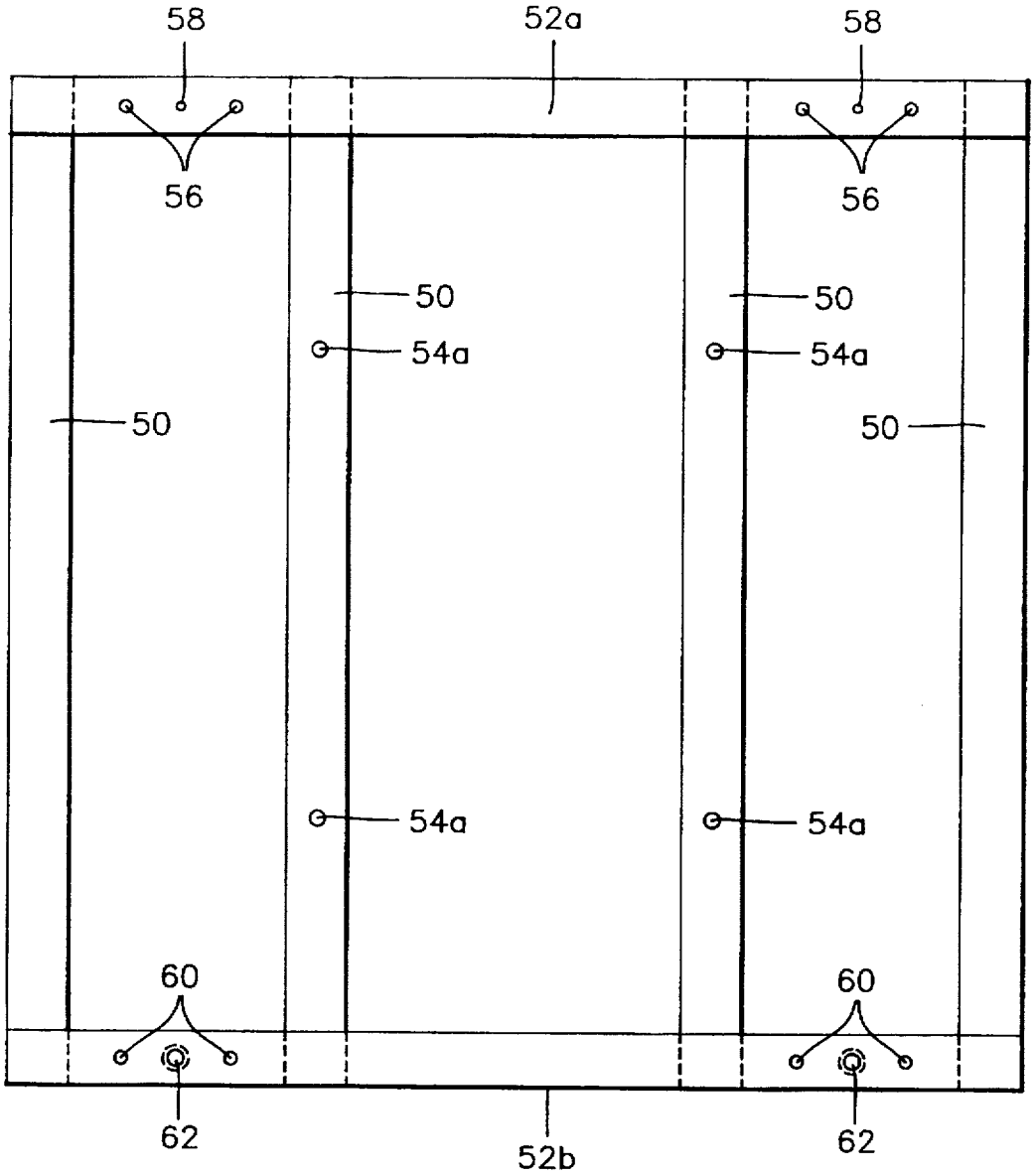
FIG. 5 is a rear view of the carriage frame on which the striking bag platform and bearing and lock assemblies are mounted.
Figure 6:
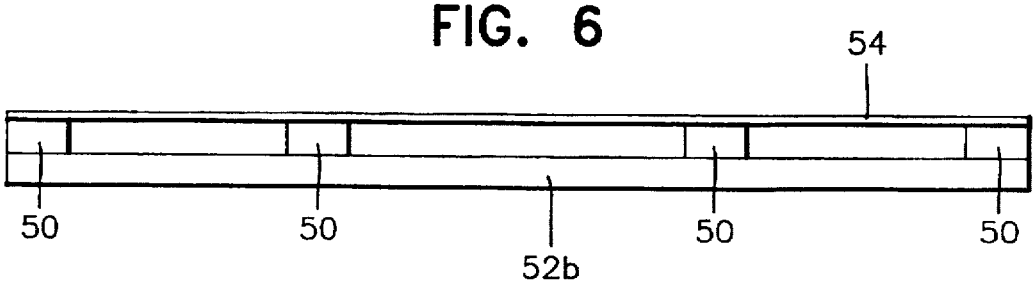
FIG. 6 is a bottom view of the carriage frame.

In FIGS. 5 and 6, the striking bag carriage assembly 14 is shown as including four rectangular-shaped tubes 50 interconnected and welded to rectangular-shaped cross-pieces **52*a* and 52*b*. Secured to an exterior surface of the tubes 50, is a rigid plastic surface plate 54. The two inner tubes 50 include holes 54*a* for mounting of brackets 64 and plate 54**.

The upper cross-brace **52*a* includes two sets of two holes 56 for securing a bearing assembly to the top of the striking bag carriage assembly. Located between the pairs of holes 56 is a pilot hole 58. In the lower cross-brace 52*b* are two sets of bolt holes 60 with a central bolt hole 62 located between each pair of holes 60**.

Figure 8:
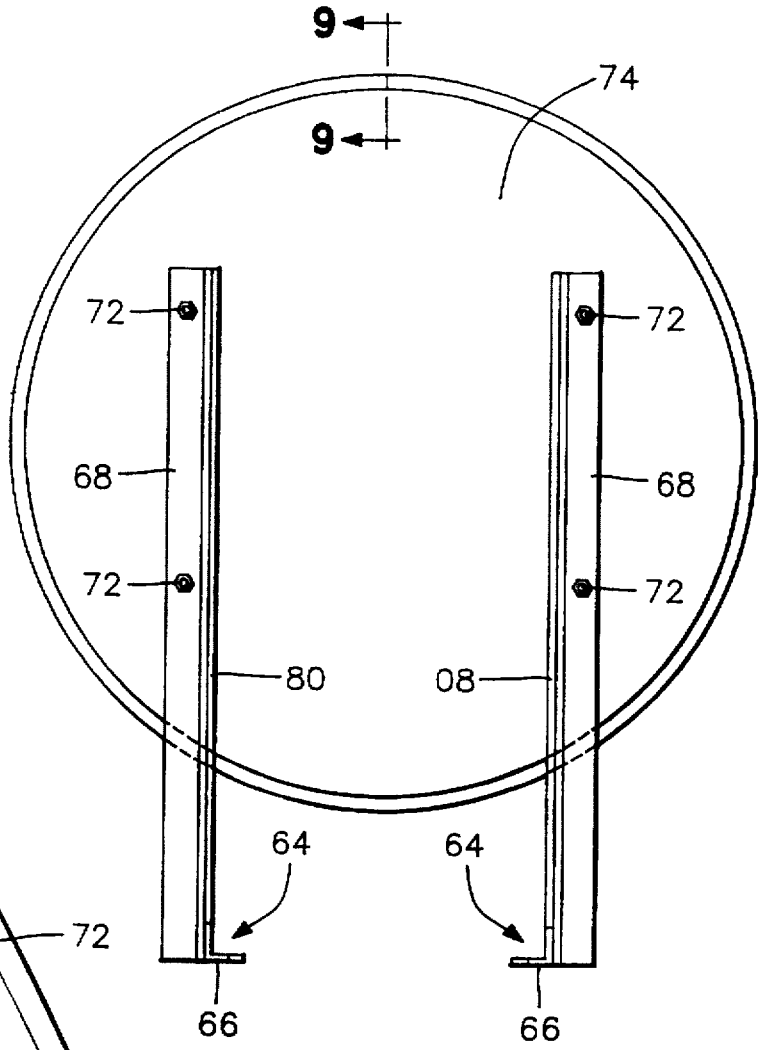
FIG. 8 is a top plan view of the striking bag assembly.
Figure 7:
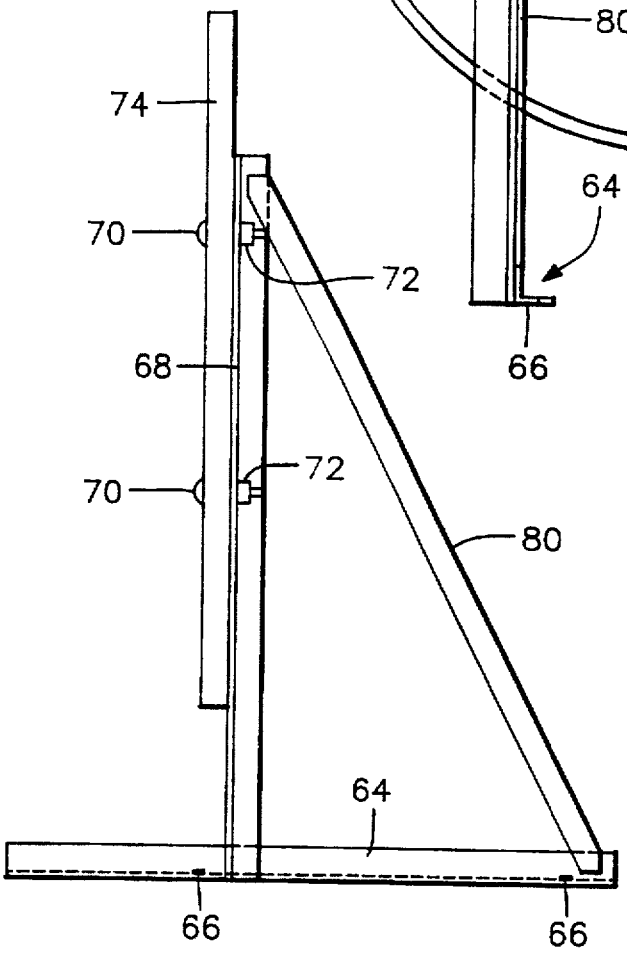
FIG. 7 is side view of the striking bag platform assembly.
Figure 9:
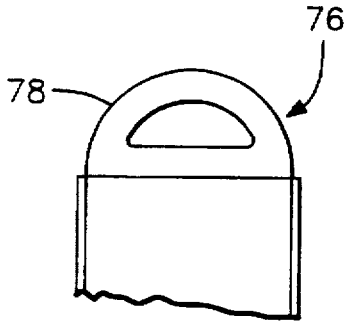
FIG. 9 is a sectional view taken along line 9—9 of FIG. 8.

In FIGS. 7 through 9, the details of the striking bag platform assembly 16 are shown. Two angle iron brackets 64, extend vertically and are secured through holes 66 through plate 54 to inner tube 50. Extending horizontally from the brackets 64 are angle iron brackets 68 which are connected through a flange by bolts 70 and nuts 72 to circular striking bag platform 74. The bolts which secure the brackets 64 to the plate 54 extend through bolt holes **54*a* in the brackets 50**.

Platform 74 includes semi-circular protective edging 76, as shown in FIG. 9, having an outer lip 78 of a compressible material. To complete the striking bag platform assembly, diagonally-extending bars 80 interconnect the brackets 64 and 68 for strength and stability.

As shown in FIGS. 1 and 2, the striking bag platform 74 includes a mounting bracket 82 to which is connected a striking bag 84 by a pivot connection 86. The bag 84 is free to move in all directions on pivot connection 86.

To raise and lower the striking bag carriage assembly 14, a counterweight 82 is slidably mounted in each of the tubes 28. The two counterweights approximate the weight of the striking bag carriage assembly 14 and striking bag platform assembly 16 so that when the carriage assembly is manually moved, it will remain at the position to which is manually moved upon release of further manual movement.

Figure 13:
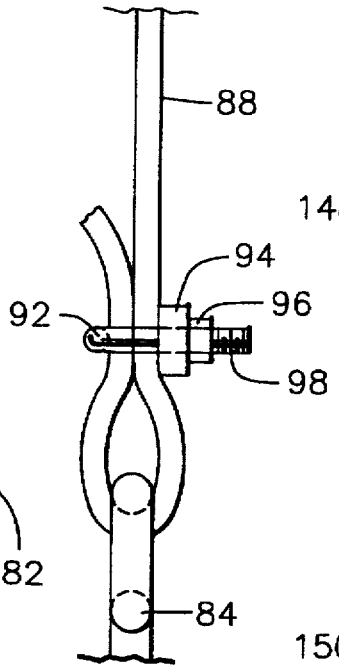
FIG. 13 is a side view of the attachment of a screw eye of a counterweight to a lifting cable.

The counterweights 82 each include a screw eye 84 secured at an upper end 86. A cable 88 is connected to the screw eye 84 by passing an end of the cable through the opening 90 of the screw eye, as shown in FIG. 13, and securing it to itself by a U-shaped clamp bar 92 encircling two portions of the cable 88. A crossbar 94, having two holes positioned over the ends of bar 92, is moved into engagement with the cable by the rotation of a nut 96 at both of the threaded ends 98 of the U-shaped clamp 92.

The cable 88 extends from the upper end 86 of the counterweight, up out of the tubes 28 and around the pulleys 46 as received in the groove 48 of each pulley. The other end of the cable is secured to a screw eye 100 located in the top cross-piece **52*a* of the carriage assembly 14. As with the securing of the end of the cable to the counterweight, a U-shaped clamp bar 102 having a cross-piece 104 includes nuts secured onto the ends 106 of the U-shaped clamp 102** to fix the cable to the carriage assembly.

Figure 10:
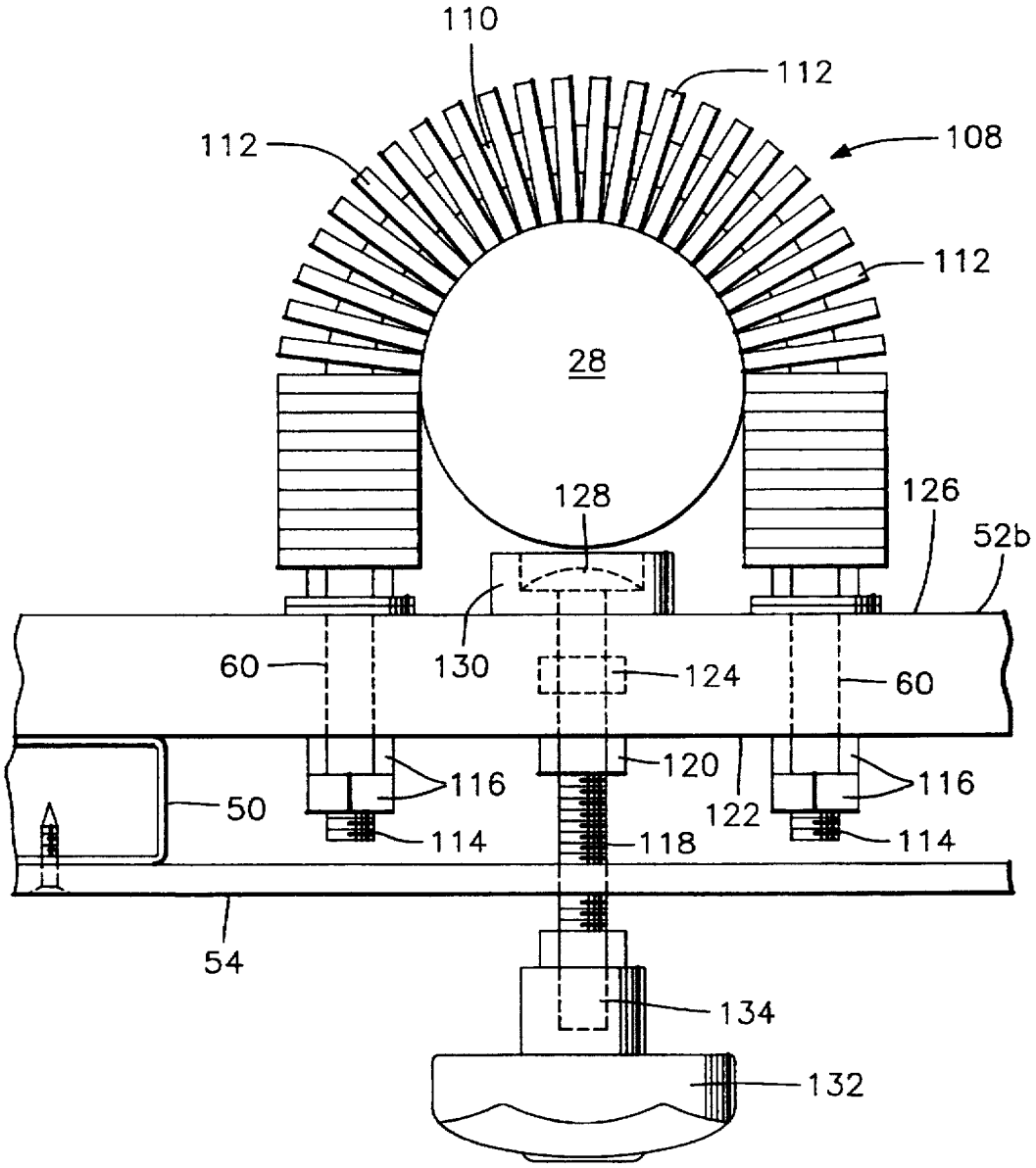
FIG. 10 is a detailed plan view of one of two lower bearing and stabilizer locks extending from the striking bag carriage assembly and surrounding a vertically extending cylindrical tube.

As a safety precaution, two bearing and lock assemblies 108, as singularly shown in FIG. 10, are located extending from cross-piece **52*b* for fixing the platform assembly 16 at a predetermined position. Each bearing and lock assembly 108 includes a U-shaped rod 110 onto which is mounted a plurality of nylon roller bearings 112 which surround the exterior surface of cylindrical tube 28. The opposite ends 114 of the rod 110 pass through the bolt holes 60 in the cross-brace 52*b* and are secured in place by lock nuts 116. Located in between the ends 114 of the rod 110 is a bolt 118 which extends through a nut 120 welded on the surface 122 of bottom cross-piece 52*b*. The bolt passes through internal limit nut 124 until passing through the surface 126 of cross-piece 52*b*. The head 128 of the bolt is embedded in a bearing pad 130**.

Upon rotation of knob 132 mounted on opposite end 134 of bolt 118, the bearing pad 130 is either moved towards or away from the cylindrical tube 28. Upon engagement of the pad 130 with the tube 28, the position of the carriage assembly 14 is locked. Similarly, upon opposite direction rotation of the knob 132, the bearing pad is backed away from the tube 28 so as to allow sliding movement of the carriage assembly 14 with respect to the tube as assisted by the nylon rollers 112 which surround and engage the tube 28.

Figure 11:
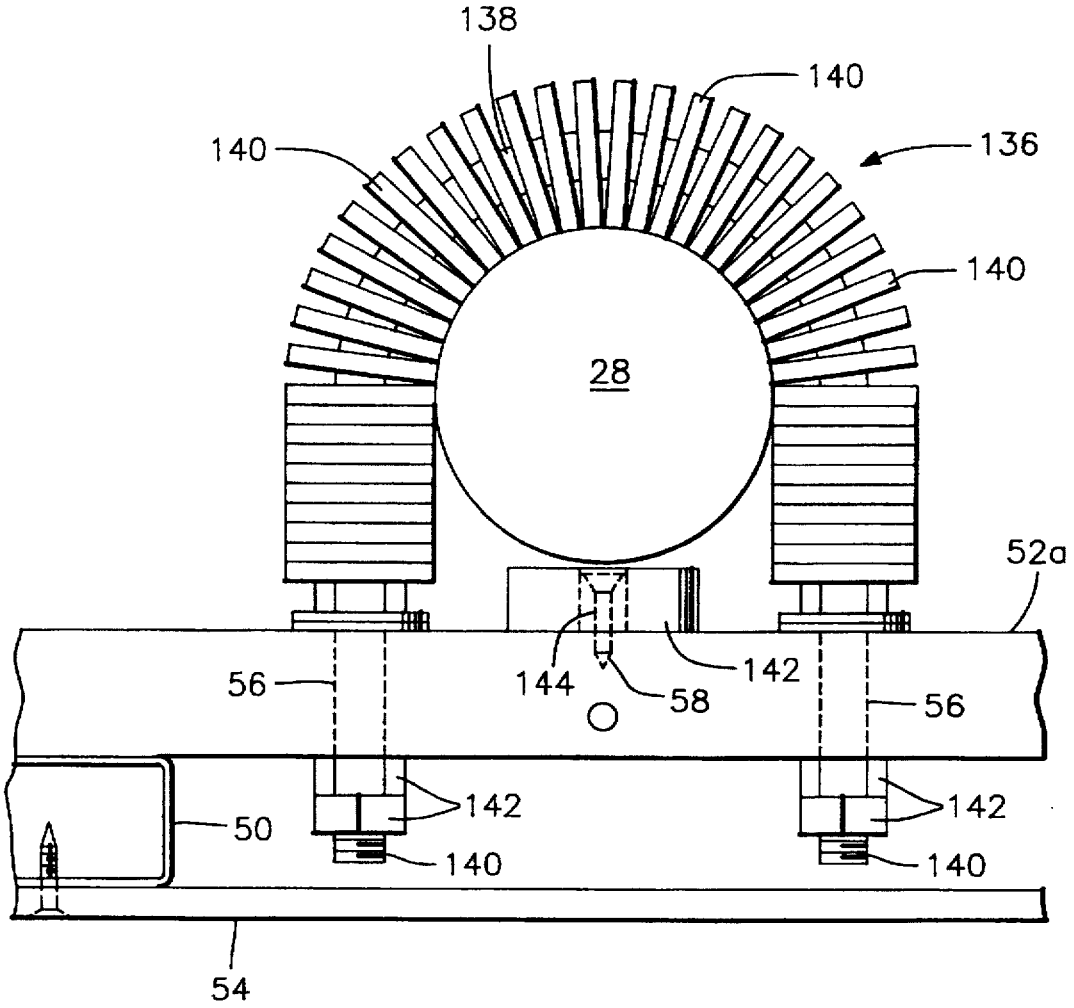
FIG. 11 is a detailed plan view of one of two upper bearings extending from the striking bag carriage assembly and surrounding a vertically extending cylindrical tube.
Figure 12:
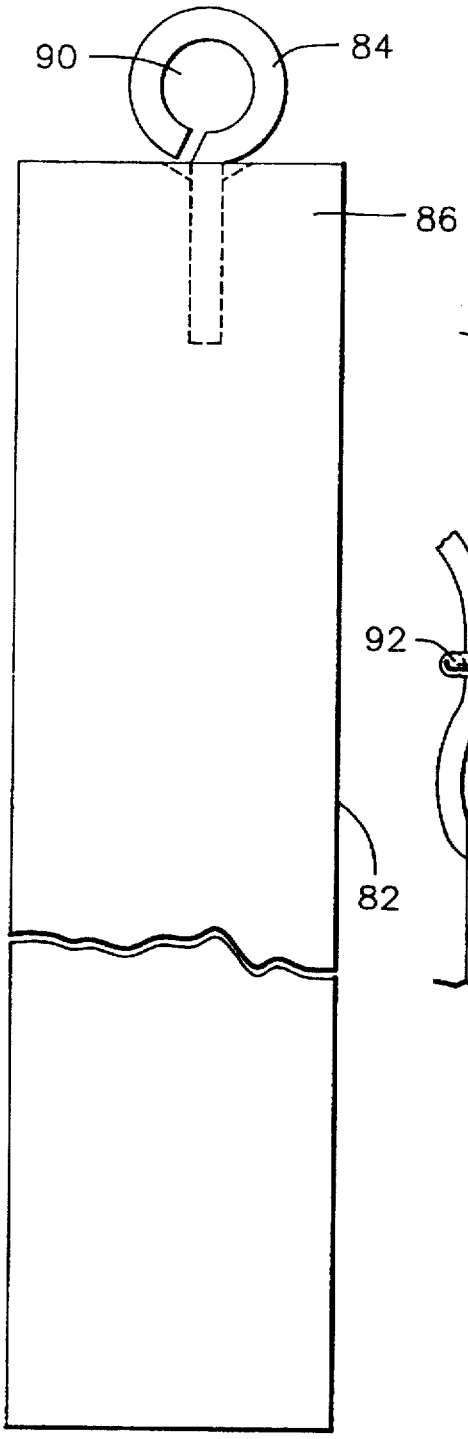
FIG. 12 is a front view of one of two counterweights which are enclosed within the cylindrical tubing of the main frame unit.

As shown in FIG. 11, one of the two bearing assemblies 136 is shown which are located secured to the upper cross-piece **52*a* of the carriage assembly 14. In this assembly, a U-shaped rod 138 has opposite ends 140 which extend through holes 56 in the cross-piece 52*a*. The ends 140 are secured in place by lock nuts 142. Rotatably mounted on the rod 138 are a plurality of nylon roller bearings 140 which assist in the moving of the carriage assembly 14 along the length of tubes 28**.

A bearing pad 142 is secured in place by a screw 144 extending into pilot hole 58. The bearing pad 142 is normally spaced away from the tube 28 at a slight distance so that upon drawing of the bottom of the carriage assembly 14 towards the tubes 28 by the bearing and lock assemblies 108, a lowermost edge of the bearing pad 142 slightly engages the peripheral edge of the tube 28 to assist in maintaining the fixed position of the carriage assembly. Upon release of the bearing and latch assemblies 108 from the fixed position for the carriage assembly 14, the orientation of the carriage assembly 14 will be shifted slightly so as to provide clearance between the bearing pads 142 and the tubes 28 to facilitate sliding movement of the carriage assembly through the system of guide cables 88 and counterweights 82.

Figure 14:
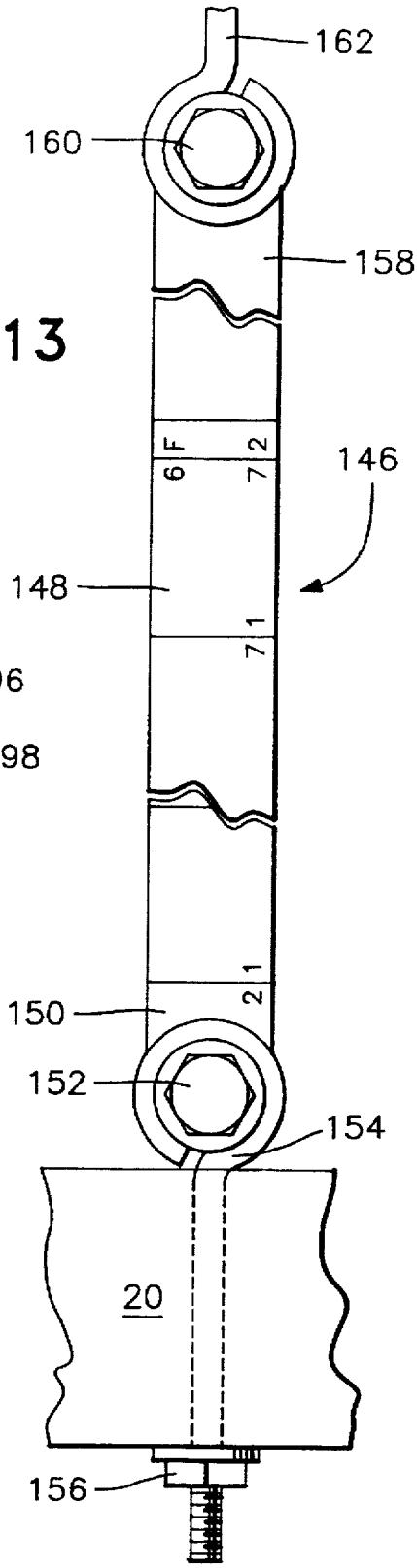
FIG. 14 shows a front view of the mounting of the elevation height scale between horizontally extending rectangular tubing brackets of the main frame unit.

To assist in returning the carriage assembly to a specific location for a particular individual, a height scale assembly 146 as shown in FIGS. 1 and 14, includes a height scale tape 148 which at a lower end 150 is secured by a bolt 152 passing through the opening of an eye hook 154 secured to bracket 20 by nut 156. At the opposite end 158 of the tape 148, a bolt 160 passing through the scale 158 and the opening of an eye hook 162, secures the scale in position. Eye hook 162 extends through bracket 22 and is held in position by a nut 164.

By aligning a bottom edge of the carriage assembly 14 with a measurement on the tape 148, an exact repositioning of the carriage assembly to a predetermined height is possible. The carriage assembly can be moved from this position and returned to the exact same position by notation of the indicia on the tape 148.

Having described the invention, many modifications thereto will become apparent to those skilled in the art to which it pertains without deviation from the spirit of the invention as defined by the scope of the appended claims.

I claim:

1. An adjustable height target assembly comprising:

a frame unit including a plurality of brackets for attachment to a vertical wall and two tubes extending between said plurality of brackets, a carriage assembly slidably mounted on said frame unit, said carriage assembly including two cables secured to said carriage assembly at one end and secured at an opposite end to a counterweight slidably mounted within each of said two tubes, and said carriage assembly also including a bearing and locking assembly for engaging one of said tubes to lock a position of said carriage assembly, said bearing and locking assembly having a U-shaped rod extending through a plurality of roller bearings mounted on said U-shaped rod so that said roller bearings and said U-shaped rod surround and engage said tube, a platform assembly mounted on said carriage assembly, said platform assembly including a pivotally mounted target for practicing hitting and kicking.

2. An adjustable height target assembly according to claim 1, wherein said carriage assembly includes said bearing and locking assembly at a lower end thereof.

3. An adjustable height target assembly comprising:

a frame unit including brackets for attachment to a wall and two hollow tubes secured to and extending between said brackets, a carriage unit slidable along and lockable to said two tubes, a bearing and locking assembly for facilitating sliding and locking of said carriage assembly on said tubes, said bearing and locking assembly including a U-shaped rod extending through a plurality of roller bearings mounted on said U-shaped rod so that said roller bearings and said U-shaped rod surround and engage said tube, and a platform assembly mounted on said carriage assembly, said platform assembly including a pivotally mounted target for practicing hitting and kicking.

4. An adjustable height target assembly according to claim 1, wherein said bearing and locking assembly includes a bearing pad for engaging and locking with said tube.

5. An adjustable height target assembly according to claim 1, wherein a height scale assembly extends along said tubes.

6. An adjustable height target assembly according to claim 1, wherein a pulley assembly is located at a top end of each of said tubes.

7. An adjustable height target assembly according to claim 1, wherein there are three brackets for attachment to the vertical wall.

8. An adjustable height target assembly according to claim 1, wherein said roller bearings are made of nylon.

9. An adjustable height target assembly comprising a frame unit including brackets for attachment to a wall and two hollow tubes secured to and extending between said brackets, a carriage unit slidable along and lockable to said tubes, a bearing and locking assembly for facilitating sliding and locking of said carriage assembly on said tubes, said bearing and locking assembly including a U-shaped rod having a plurality of roller bearings on said U-shaped rod so that said roller bearings surround and engage said tube, and a platform assembly mounted on said carriage assembly, said platform assembly including a target for practicing hitting and kicking.

10. An adjustable height target assembly according to claim 9, wherein said carriage assembly includes said bearing and locking assembly at a lower end thereof.

11. An adjustable height target assembly according to claim 9, wherein a bearing assembly is included on an upper end of said carriage assembly to guide movement of said carriage assembly along said tube.

12. An adjustable height target assembly according to claim 9, wherein said bearing and locking assembly includes a bearing pad for engaging and locking with said tube.

13. An adjustable height target assembly according to claim 9, wherein a height scale assembly extends along said tubes.

* * * * *